United States Patent [19]

Mooneyhan

[11] Patent Number: 4,554,934

[45] Date of Patent: Nov. 26, 1985

[54] HAIR CLAMP DEVICE

[76] Inventor: Betty F. Mooneyhan, 278 Sunflower, Clarksdale, Miss. 38614

[21] Appl. No.: 661,096

[22] Filed: Oct. 15, 1984

Related U.S. Application Data

[63] Continuation-in-part of Ser. No. 613,777, May 24, 1985, abandoned.

[51] Int. Cl.[4] ..... A45D 2/00; A45D 24/36

[52] U.S. Cl. ..... 132/40; 132/45 R; 132/46 R

[58] Field of Search ..... 132/33 R, 40, 41 R, 132/41 A, 41 B, 41 C, 45 R, 45 A, 7, 9, 1 R, 46 R, 46 A

[56] References Cited

U.S. PATENT DOCUMENTS

| | | | |
|---|---|---|---|
| 2,655,159 | 10/1953 | Parkey | 132/40 |
| 3,105,501 | 10/1963 | Scotti | 132/41 R |
| 3,343,549 | 9/1967 | Weitzner | 132/40 |
| 3,779,255 | 12/1973 | Theodorides | 132/41 A |
| 4,291,714 | 9/1981 | Mariani | 132/40 |

*Primary Examiner*—Gene Mancene
*Assistant Examiner*—Carolyn A. Harrison
*Attorney, Agent, or Firm*—Walker & McKenzie

[57] ABSTRACT

A clamp for being attached to a pin curl or the like. The clamp includes a pair of bowls, or the like, with a flat disc member mounted over the mouth of each bowl by way of a spring which urges the disc members outwardly of the bowl, and hinge structure for pivotally joining the bowls to one another and for normally urging the rims of each bowl substantially against one another whereby a pin curl is securely clamped between the disc members.

13 Claims, 5 Drawing Figures

HAIR CLAMP DEVICE

CROSS-REFERENCE TO RELATED APPLICATION

This is a continuation-in-part of my application, Ser. No. 06/613,777, filed May 24, 1984, now abandoned entitled "Pop-In's".

BACKGROUND OF THE INVENTION

1. Field of the Invention

The present invention relates, in general, to devices for being clamped to a strand of hair as an aid in curling the strand of hair or the like or for ornamentation.

2. Description of the Prior Art

Heretofore, various hair clips and curling devices, and the like, have been developed. See, for example, Loewenstein, U.S. Pat. No. 2,589,832; Parkey, U.S. Pat. No. 2,655,159; Fracter, U.S. Pat. No. 2,850,022; Whitmore, U.S. Pat. No. 2,688,019; Cattermold, U.S. Pat. No. 2,977,069; Safianoff, U.S. Pat. No. 3,105,503; Brien, U.S. Pat. No. 3,173,430; Coloccia, U.S. Pat. No. 3,200,824; Weitzner, U.S. Pat. No. 3,343,549; Dorr, U.S. Pat. No. 3,998,233; Mariani, U.S. Pat. No. 4,291,714; Anderson, U.S. Pat. No. 4,317,461; and Brown, U.S. Pat. No. 4,372,329. None of the above patents disclose or suggest the present invention.

SUMMARY OF THE INVENTION

The present invention consists, in general, of a first bowl member having an open cavity defining an interior surface and having a rim; a second bowl member having an open cavity defining an interior surface and having a rim; hinge means for pivotally attaching the first and second bowl members to one another and for normally urging the rims of the first and second bowl members substantially against one another to allow the open cavities of the first and second bowl members to coact to define a substantially closed cavity; a first plate member having a substantially flat obverse face and having a reverse face; a first spring member having a first end attached to the reverse face of the first plate member and having a second end attached to the interior surface of the cavity of the first bowl member to normally urge the obverse face of the first plate member outwardly of the rim of the bowl member; a second plate member having a substantially flat obverse face and having a reverse face; and a second spring member having a first end attached to the reverse face of the second plate member and having a second end attached to the interior surface of the cavity of the second bowl member to normally urge the obverse face of the second plate member outwardly of the rim of the second bowl member and substantially against the obverse face of the first plate member to securely hold a strand of hair between the obverse faces of the first and second face members when the rims of the first and second bowl members are urged substantially against one another.

DESCRIPTION OF THE PREFERRED EMBODIMENT

Figure 1:
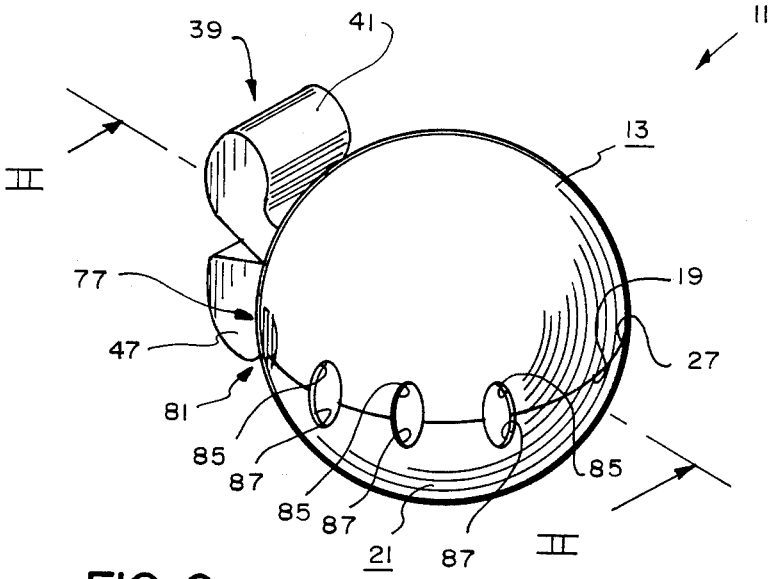
FIG. 1 is a perspective view of the hair clamp device of the present invention.

The device 11 of the present invention is for being clamped to a strand S of hair. More specifically, the device 11 can be clamped to a strand of a person's hair relatively close to the person's scalp to allow the strand of hair to be held in a specific position or the like. The device 11 is especially useful for holding the strand S of hair in a well-known pin curl. A pin curl is normally defined as a curl made usually by dampening a strand of hair with water or lotion, coiling it smoothly, and securing it in place by a hairpin or clip.

The device 11 includes a first bowl member 13 having an opened cavity 15 defining an interior surface 17 and having a rim 19. The device 11 also includes a second bowl member 21 having an opened cavity 23 defining an interior surface 25 and having a rim 27. The specific construction of the first and second bowl members 13, 21 may vary. Preferably, the first and second bowl members 13, 21 are injection molded of plastic as substantially mirror images of one another and shaped so that when the first and second bowl members 13, 21 are held with the rims 19, 27 thereof engaging one another, the cavities 15, 23 will coact to define a substantially closed cavity having a spherical, ball shape and with the exterior of the first and second bowl members 13, 21 combining to have a spherical, ball shape.

The device 11 includes hinge means 29 for pivotally attaching the first and second bowl members 13, 21 to one another and for normally urging the rims 19, 27 thereof substantially against one another. The hinge means 29 may include a pair of ear members or the like attached to the exterior of the first bowl member 13, a pair of coacting ear members or the like attached to the exterior of the second bowl member 21, a pivot rod 35 pivotally joining the ear members to one another, and a hinge spring member 37 associated with the ear members and pivot rod 35 in a manner so as to urge the first and second bowl members 13, 21 toward a closed position with the rims 19, 27 thereof urged substantially against one another. The specific construction and operation of the hinge means 29 may vary as will be apparent to those skilled in the art. It should be noted that the various ear members may be injection molded out of plastic as an integral part of the respective bowl members 13, 21.

Figure 2:
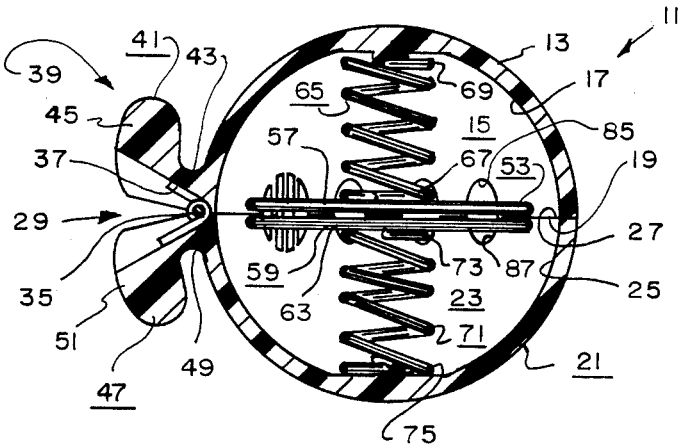
FIG. 2 is a sectional view substantially as taken on line II—II of FIG. 1.
Figure 3:
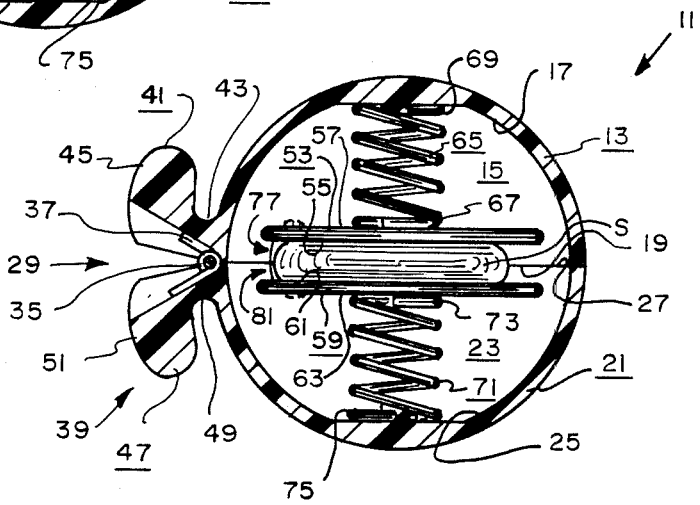
FIG. 3 is a sectional view similar to FIG. 2 but showing a strand of hair clamped thereby.
Figure 4:
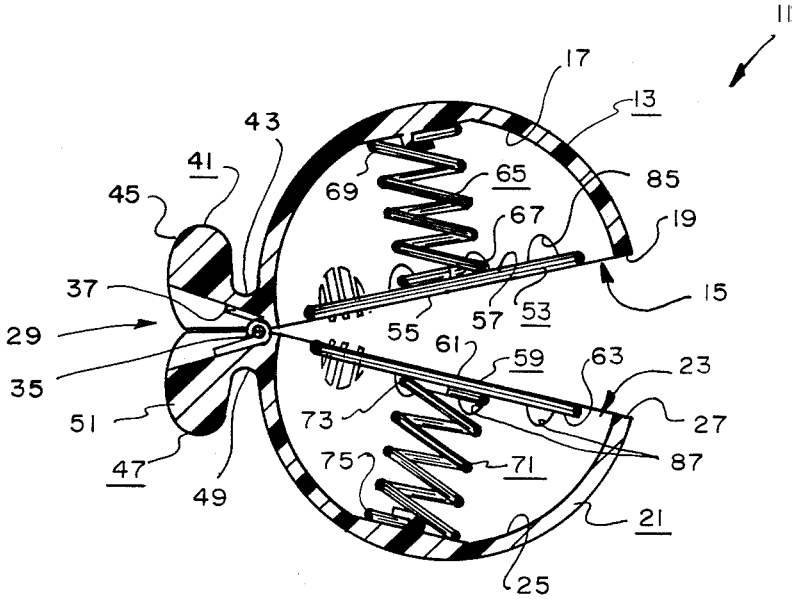
FIG. 4 is a sectional view similar to FIG. 2 but showing the device in an open position.

The device 11 preferably includes actuator means 39 for use in causing the first and second bowl members 13, 21 to pivot apart from one another relative to the hinge means 29. More specifically, the actuator means 39 allows the first and second bowl members 13, 21 to be easily moved from the normally closed position with the rims 19, 27 thereof urged against one another as shown in FIGS. 1, 2, 3 and 5 to an opened position with the rims 19, 27 away from one another as shown in FIG. 4. The actuator means 39 preferably consists of a first finger member 41 having a first end 43 fixedly attached to the first bowl member 13 adjacent the hinged means 29 and having a second end 45 extending outwardly thereof and includes a second finger member 47 having a first end 49 fixedly attached to the second bowl member 21 adjacent the hinged means 29 and having a second end 51 extending outwardly therefrom. The first and second finger members 41, 47 coact in a flipper-like manner whereby manual movement of the second ends 45, 51 thereof toward one another will cause the first and second bowl members 13, 21 to pivot apart from one another in a manner which will now be apparent to those skilled in the art. The first and second finger members 41, 47 may be injection molded out of plastic as an integral, one-piece unit with the respective first and second bowl members 13, 21.

The device 11 includes a first plate member 53 having a substantially flat obverse face 55 and having a reverse face 57 and includes a second plate member 59 having a substantially flat obverse face 61 and having a reverse face 63. The first and second plate members 53, 59 preferably consist of metal disc-like members with at least the obverse faces 55, 61 thereof being chrome plated for reasons which will hereinafter become apparent, or plastic disc-like members.

The device 11 includes a first spring member 65 having a first end 67 attached to the reverse face 57 of the first plate member 53 and having a second end 69 attached to the interior surface 17 of the cavity 15 of the first bowl member 17 to normally urge the obverse face 55 of the first plate member 53 outwardly of the rim 19 of the first bowl member 13. The device 11 includes a second spring member 71 having a first end 73 attached to the reverse face 63 of the second plate member 59 and having a second end 75 attached to the interior surface 25 of the cavity 23 of the second bowl member 21 to normally urge the obverse face 61 of the second plate member 59 outwardly of the rim 27 of the second bowl member 21. Thus, when the first and second bowl members 13, 21 are in the closed position with the rims 19, 27 thereof urged substantially against one another, the first and second spring members 65, 71 will urge the obverse faces 55, 61 of the first and second plate members 53, 59 substantially against one another as shown in FIG. 2 to securely hold a strand S of hair therebetween as shown in FIG. 3. The spring members 65, 71 may consist of typical coil springs or the like and may be fixedly attached to the respective components in any manner apparent to those skilled in the art. Thus, for example, the first ends 67, 73 of the spring members 65, 71 may be fixedly attached to the respective plate members 53, 59 by being welded thereto and the second ends 69, 75 may be fixedly attached to the respective bowl members 13, 21 by passing through an aperture in a boss member 70 provided in the opened cavity 15, 23 of each bowl member 13, 21.

The first and second spring members 65, 71 are preferably weaker than the hinged spring member 37 to allow the strand of hair held between the first and second plate members 53, 59 to compress the first and second spring members 65, 71 and to urge the first and second plate members 53, 59 apart from one another without overcoming the hinged spring member 37 and urging the rims 19, 27 of the first and second bowl members 13, 21 apart from one another (i.e., without urging the first and second bowl members 13, 21 apart from one another).

Figure 5:
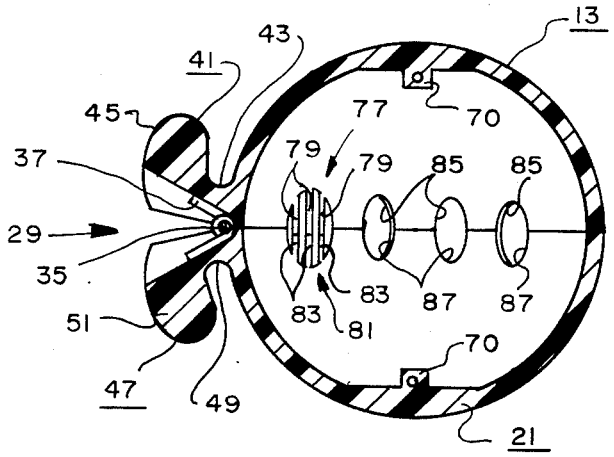
FIG. 5 is a sectional view similar to FIG. 2 but with certain components thereof removed for clarity.

The first bowl member 13 preferably has a hair passageway notch 77 in the rim 19 thereof for allowing the strand of hair to pass therethrough into the substantially closed cavity defined by the cavity 15, 23 of the first and second bowl members 13, 21 (see, in general, FIG. 5). The first bowl member 13 may also include a plurality of hair engaging teeth members 79 provided in the hair passageway notch 77 thereof for securely grasping the strand of hair passing through the hair passageway notch 77 (see, in general, FIG. 5).

The second bowl member 23 may also have a hair passageway notch 81 in the rim 27 thereof for allowing the strand of hair to pass therethrough and may also include a plurality of hair engaging teeth members 83 provided in the hair passageway notch 81 thereof for securely grasping the strand of hair passing through the hair passageway notch 81 (see, in general, FIG. 5).

The hair passageway notches 77, 81 of the first and second bowl members 13, 21 are preferably aligned with one another when the rims 19, 27 of the first and second bowl members 13, 21 are urged substantially against one another to thereby define, in effect, a single hair passageway opening and to allow the hair engaging teeth members 79, 83 of the first and second bowl members 13, 21 to overlap and coact with each other in a substantially interlocking manner (see, in general, FIG. 3).

It will be understood that the hair passageway notches 77 and/or 81 may be omitted without departing from the spirit and scope of the invention.

The first bowl member 13 may have a plurality of fluid passageways 85 therein for allowing fluid to pass therethrough (see, in general, FIG. 5). Likewise, the second bowl member 21 may have a plurality of fluid passageways 87 therein for allowing fluid to pass therethrough (see, in general, FIG. 5). The fluid passageways 85, 87 in the first and second bowl members 13, 21 are preferably defined by a plurality of notches in the rims 19, 27 of the first and second bowl members 13, 21 with each of the notches defining the fluid passageways 85 in the first bowl member 13 aligning with respective one of the notches defining the fluid passageways 87 in the second bowl member 21 when the rims 19, 27 of the first and second bowl member 13, 21 are urged substantially against one another. Each passageway 85, 87 could also be defined by an aperture cut or provided through the body of the respective bowl member 13, 21.

The operation and use of the device 11 is quite simple. Thus, to clamp the device 11 to a strand S of hair the second ends 45, 51 of the first and second finger members 43, 47 are manually urged toward one another thus causing the first and second bowl members 13, 21 to open relative to one another and causing the first and second plate members 53, 59 to move apart from one another. The strand S of hair can then be positioned between the obverse faces 55, 61 of the first and second plate members 53, 59. The strand of hair may first be dampened with water or lotions and coiled smoothly into a pin curl or the like in any well known manner. The finger members 41, 47 are then released allowing the plate members 53, 59 to clamp the strand of hair therebetween and allowing the bowl members 13, 21 to close thus forming a substantially closed cavity about the plate members 53, 59 and the strand of hair. It should be noted that the plate members 53, 59 may be heated before the strand of hair is clamped therebetween in various manners such as, for example, by being held in contact in any preheated element or the like. Since the plate members 53, 59 are preferably constructed of metal or impervious plastic for perming, they can be readily heated. On the other hand, heat may be applied to the strand of hair after the device 11 is clamped thereto by placing a standard hair dryer, or the like over the person's head with the device 11 attached thereto whereby heated air is free to enter the substantially closed cavity defined by the opened cavities 15, 23 through the fluid passageways 85, 87. Also, if desired, water or the like can be directed through the fluid passageways 85, 87 to rinse the strand of hair held between the plate members 53, 59.

Although the present invention has been described and illustrated with respect to a preferred embodiment thereof and a preferred use therefore, it is not to be so limited since changes and modifications can be made therein which are within the full intended scope of the invention.

I claim:

1. A device for being clamped to a strand of hair, said device comprising:

(a) a first bowl member having an opened cavity defining an interior surface and having a rim;

(b) a second bowl member having an opened cavity defining an interior surface and having a rim;

(c) hinge means for pivotally attaching said first and second bowl members to one another and for normally urging said rims of said first and second bowl members substantially against one another to allow said opened cavities of said first and second bowl members to define a substantially closed cavity;

(d) a first plate member having a substantially flat obverse face and having a reverse face;

(e) a first spring member having a first end attached to said reverse face of said first plate member and having a second end attached to said interior surface of said cavity of said first bowl member to normally urge said obverse face of said first plate member outwardly of said rim of first bowl member;

(f) a second plate member having a substantially flat obverse face and having a reverse face; and.

(g) a second spring member having a first end attached to said reverse face of said second plate member and having a second end attached to said interior surface of said cavity of said second bowl member to normally urge said obverse face of said second plate member outwardly of said rim of said second bowl member and substantially against said obverse face of said first plate member to securely hold a strand of hair between said obverse faces of said first and second plate members when said rims of said first and second bowl members are urged substantially against one another.

2. The device of claim 1 in which said hinge means includes a hinge spring member to normally urge said rims of said first and second bowl members substantially against one another, and in which said first and second spring members are weaker than said hinge spring member to allow the strand of hair held between said first and second plate members to compress said first and second spring members and to urge said first and second plate members apart from one another without overcoming said hinge spring member and urging said rims of said first and second bowl members apart from one another.

3. The device of claim 1 in which said first bowl member has a hair passageway notch in said rim thereof for allowing the strand of hair to pass therethrough into said substantially closed cavity defined by said opened cavities of said first and second bowl members.

4. The device of claim 3 in which said first bowl member includes a plurality of hair engaging teeth members provided in said hair passageway notch thereof for securely grasping the strand of hair passing through said hair passageway notch.

5. The device of claim 4 in which said second bowl member has a hair passageway notch in said rim thereof for allowing the strand of hair to pass therethrough into said substantially closed cavity defined by said opened cavities of said first and second bowl members, and in which said second bowl member includes a plurality of hair engaging teeth members provided in said hair passageway notch thereof for securely grasping the strand of hair passing through said hair passageway notch.

6. The device of claim 5 in which said hair passageway notches of said first and second bowl members align with one another when said rims of said first and second bowl members are urged substantially against one another, and in which said hair engaging teeth of said first and second bowl members coact with each other in a substantially interlocking manner.

7. The device of claim 3 in which is included actuator means for use in causing said first and second bowl members to pivot apart from one another relative to said hinge means and for moving said obverse faces of said first and second plate members apart from one another.

8. The device of claim 7 in which said actuator means includes a first finger member having a first end fixedly attached to said first bowl member adjacent said hinge means and having a second end extending outwardly thereof, and includes a second finger member having a first end fixedly attached to said second bowl member adjacent said hinge means and having a second end extending outwardly therefrom, manual movement of said second ends of said first and second finger members causing said first and second bowl members to pivot apart from one another.

9. The device of claim 3 in which said first bowl member has a plurality of fluid passageways therein for allowing fluid to pass therethrough.

10. The device of claim 9 in which said second bowl member has a plurality of fluid passageways therein for allowing fluid to pass therethrough.

11. The device of claim 10 in which said fluid passageways of said first bowl member are defined by a plurality of notches in said rim of said first bowl member, and in which said fluid passageways of said second body member are defined by a plurality of notches in said rim of said second bowl member.

12. The device of claim 11 in which each of said notches defining said fluid passageways of said first bowl member aligns with a respective one of said notches defining said fluid passageways of said second bowl member when said rims of said first and second bowl members are urged substantially against one another.

13. The device of claim 3 in which said first and second plate members are constructed of metal.

* * * * *